US005986247A

United States Patent [19]

Hayashi et al.

[11] Patent Number: 5,986,247

[45] Date of Patent: Nov. 16, 1999

[54] HIGH FREQUENCY HEATING DEVICE WHICH IS SAFE WHEN ITS EXTERIOR IS REMOVED

[75] Inventors: Hiroki Hayashi; Hideki Yamauchi; Junji Murata; Kazuhiko Kawamura; Keiji Harada, all of Shiga, Japan

[73] Assignee: Sanyo Electric Co., Ltd., Moriguchi, Japan

[21] Appl. No.: 08/901,307

[22] Filed: Jul. 28, 1997

[30] Foreign Application Priority Data

Jul. 30, 1996 [JP] Japan ..... 8-200530 (P)

[51] Int. Cl.[6] ..... H05B 6/68

[52] U.S. Cl. ..... 219/723; 219/715; 219/756; 200/50.14; 200/61.62; 126/197

[58] Field of Search ..... 219/723, 722, 219/724, 756, 702, 715; 200/50.02, 50.14, 50.1, 50.08, 61.62, 61.76, 61.81; 126/197

[56] References Cited

U.S. PATENT DOCUMENTS 3,691,329 9/1972 Ball ..... 219/722
4,277,659 7/1981 DeRemer ..... 200/61.62
5,235,150 8/1993 Buske et al. ..... 219/722
5,818,015 10/1998 Lee et al. ..... 219/723

FOREIGN PATENT DOCUMENTS 52-37241 3/1977 Japan ..... 219/723
55-56534 4/1980 Japan .
58-28888 6/1983 Japan .

*Primary Examiner*—Philip H. Leung
*Attorney, Agent, or Firm*—Armstrong, Westerman, Hattori, McLeland & Naughton

[57] ABSTRACT

A high frequency heating device having a switching member screwed into a screw hole formed in a flange and fixed to the exterior. When the exterior is fixed to the body, a through-hole formed at that portion in the rear plate of the body through which the switching member passes is too large for the switching member. Thus, while the switching member is fixable to the exterior, the switching member cannot be fixed to the body onto which the exterior is not mounted. Therefore, a high frequency heating device can be provided, wherein an exterior switch more surely keeps the power supply circuit open when the exterior is removed.

15 Claims, 13 Drawing Sheets

HIGH FREQUENCY HEATING DEVICE WHICH IS SAFE WHEN ITS EXTERIOR IS REMOVED

BACKGROUND OF THE INVENTION

1. Field of the Invention

The present invention relates to a high frequency heating device, such as microwave ovens, and, in particular, to a high frequency heating device including an exterior switch which opens the power supply circuit of the device when its removable exterior for covering an outer surface of the device is removed.

2. Description of the Related Art

High frequency heating devices generally used include a portion which has a high voltage of approximately three to four kV in the machinery chamber and they are provided with an exterior switch which opens the power supply circuit when the exterior for covering an outer surface of the devices is removed so that servicing people or the like do not get an electric shock when they work on maintenance of the devices. For example, Japanese Patent Publication No. 58-28888 discloses a high frequency heating device having an exterior switch turned on and off by the exterior.

FIG. 15 is a partially exploded, perspective view showing a high frequency heating device disclosed in Japanese Patent Publication No. 58-28888. In a microwave oven shown in FIG. 15 as one example of the high frequency heating device, an exterior 902 covers an outer surface of the body including a door 903 provided at the front side of the device and is fixed to the body by a screw 904.

An exterior switch 905 which opens and closes the power supply circuit of the device closes the contact point when one wall surface of exterior 903 presses an actuator 906. That is, exterior switch 905 closes the power supply circuit when exterior 903 is mounted, and it opens the power supply circuit when exterior 903 is removed.

When exterior 903 is removed, however, actuator 906 can be inadvertently pressed due to careless behavior of servicing people or the like. More specifically, since exterior switch 905 is structured to be operated only by flat exterior 906, the contact point of the exterior switch can be closed with exterior 903 removed when actuator 906 is inadvertently pressed. This means that for microwave oven 900, the power supply circuit can be closed with exterior 903 removed, and maintenance of the device by servicing people or the like is considerably dangerous.

Furthermore, the screws which fix the exterior to the body can be removed using commercially available drivers, and one without technical knowledge can readily remove the exterior.

Thus, it is desirable that the exterior switch more surely keeps the power supply circuit open in such a heating device when its exterior is removed.

SUMMARY OF THE INVENTION

One object of the present invention is to provide a high frequency heating device which keeps a power supply circuit open when an exterior is removed.

Another object of the present invention is that an exterior switch more surely keeps a power supply circuit open in a high frequency heating device.

Still another object of the present invention is that an exterior switch is not turned on in a high frequency heating device when one without technical knowledge removes the exterior.

Still another object of the present invention is that a box member for housing an exterior switch is arranged in a high frequency heating device without blocking the air flow from a cooling fan.

The above objects of the present invention are achieved by a high frequency heating device including: a high frequency heater; a power supply circuit for supplying voltage to the high frequency heater; a heating chamber for housing a food heated by the high frequency heater; a body surrounding the heating chamber and having the high frequency heater and the power supply circuit fixed thereto; a removable exterior for covering an outer surface of the body; an exterior switch provided between the exterior and the heating chamber for opening and closing the power supply circuit; and a switching member provided at the exterior for operating the exterior switch to close the power supply circuit when the exterior is mounted to the body and to open the power supply circuit when the exterior is removed from the body.

The exterior switch opens and closes the power supply circuit by means of the switching member provided at the exterior. Accordingly, the exterior switch can be prevented from inadvertently closing the power supply circuit when the exterior is removed, and thus the exterior switch can more surely keep the power supply circuit open.

Preferably, the switching member is fixable only to the exterior and causes the exterior switch to close the power supply circuit through fixation thereof to the exterior when the exterior is mounted to the body.

When the exterior is removed, the switching member will never be fixed to the device. Thus, the exterior switch can be prevented from inadvertently closing the power supply circuit and the exterior switch can more surely keep the power supply circuit open.

More preferably, the switching member is provided integral to the exterior.

Since the switching member is provided integral to the exterior, the number of parts for manufacturing the high frequency heating device can be reduced. Thus, the aforementioned high frequency heating device can more readily and conveniently be provided. Furthermore, the exact exterior substantially operates the exterior switch and thus the aforementioned effects are ensured.

More preferably, the high frequency heating device also includes a box member fixed to the body, and a connection terminal for connecting the exterior switch to the power supply circuit, and the box member houses the exterior switch and the connection terminal.

In accordance with the aforementioned configuration, the interior of the device is well-ordered and it is difficult to recognize the exterior switch at a glance when the exterior is removed. Thus, if one without technical knowledge should remove the exterior, he or she is less likely to inadvertently touch the exterior switch.

More preferably, the high frequency heating device also includes a cooler for cooling the high frequency heater, and a diaphragm provided above the cooler for dividing the body into a plurality of spaces, and the box member is positioned above on the diaphragm.

According to the above configuration, the box member for housing the exterior switch can be arranged without blocking the air flow from the cooling fan.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1OA is a rear view of the body when the exterior is mounted thereto.

DESCRIPTION OF THE PREFERRED EMBODIMENTS

Figure 1:
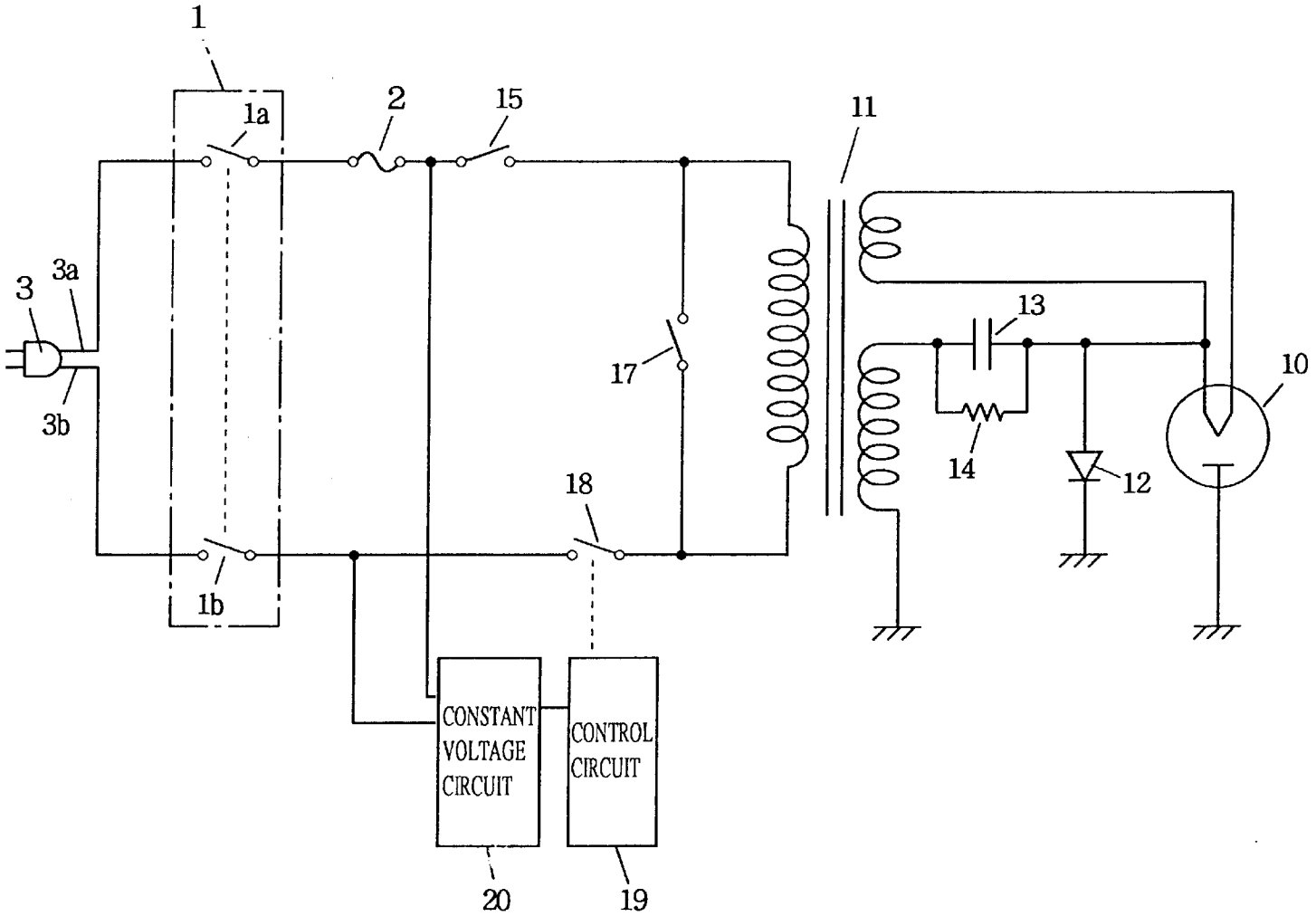
FIG. 1 is a circuit diagram showing a partial configuration of a microwave oven as one example of a high frequency heating device according to the present invention.

Referring to FIG. 1, a power supply circuit of a microwave oven includes a magnetron 10 as one example of high frequency oscillators, a high voltage transformer 11, a high voltage diode 12, and a high voltage capacitor 13. High voltage transformer 11, high voltage capacitor 13 and high voltage diode 12 form a half-wave multiplier voltage circuit which supplies high voltage (3 to 4 kV) to magnetron 10.

A discharge resistor 14 is provided in parallel with high voltage capacitor 13 and discharges electricity charged in high voltage capacitor 13 after power feed is stopped. Discharge resistor 14 connected to high voltage capacitor 13 in parallel, as shown in FIG. 1, is that which completes discharge of high voltage capacitor 13 in approximately one minute after the power supply is turned off.

The reason why electricity is discharged in the high frequency heating device according to the present invention after power feed is stopped is as follows: even when a serving personnel or the like stops power feed to the device in working on maintenance of the device, for example, by plugging off the power feed line, there still is voltage as high as approximately 3kV to 4kV in the machinery chamber and thus he or she can be electrocuted when he or she touches it.

Furthermore, the power supply circuit of the microwave oven includes a door switch 15 and a monitor switch 17 which prevents power feed to the circuit when door switch 15 does not normally operate. Door switch 15 is provided in general microwave ovens for forcibly preventing the oscillation of high frequency caused by the magnetron, and operates when the door is opened and closed.

Furthermore, the power supply circuit of the microwave oven includes a power feed line 3 which connects the high frequency heating device to an external power supply to supply voltage to the device, an exterior switch 1 which prevents power feed from the external power supply when the exterior of the device, which will be described later, is removed, and a fuse 12. Power supply line 3 includes a first line into which current flows, and a second, grounded line. Exterior switch 1 is formed of two switches, that is, a current receiving switch 1*a* connected to the first line and a ground switch 1*b* connected to the second line.

Furthermore, the power supply circuit of the microwave oven includes an operation switch which regulates energizing of magnetron 10 for heat-cooking, a control circuit 19 which controls the operation of the entire microwave oven, and a constant voltage circuit 20 which supplies constant voltage to control circuit 19. It should be noted that this microwave oven is connected to an external input key (not shown) through which a user inputs a desired cooking menu, a motor (not shown) which drives a cooling fan for cooling the magnetron the temperature of which has risen due to its oscillation, timer (not shown) which times cooking time or the like, and the like. For example, when the information that cooking is started is input to control circuit 19 via the external input key, control circuit 19 controls operation switch 18 to close the circuit, magnetron 10 is energized and heat-cooking is started.

Figure 2A:
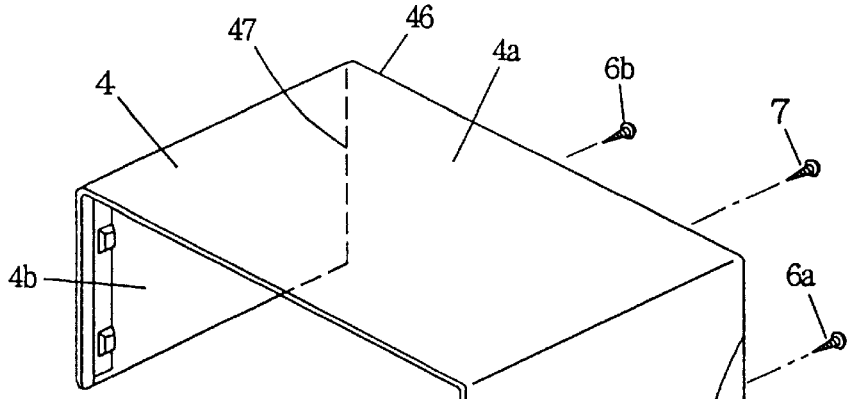
FIGS. 2A, 2B and 2C are partially exploded, perspective views of a microwave oven as one example of a high frequency heating device according to the present invention.
Figure 2B:
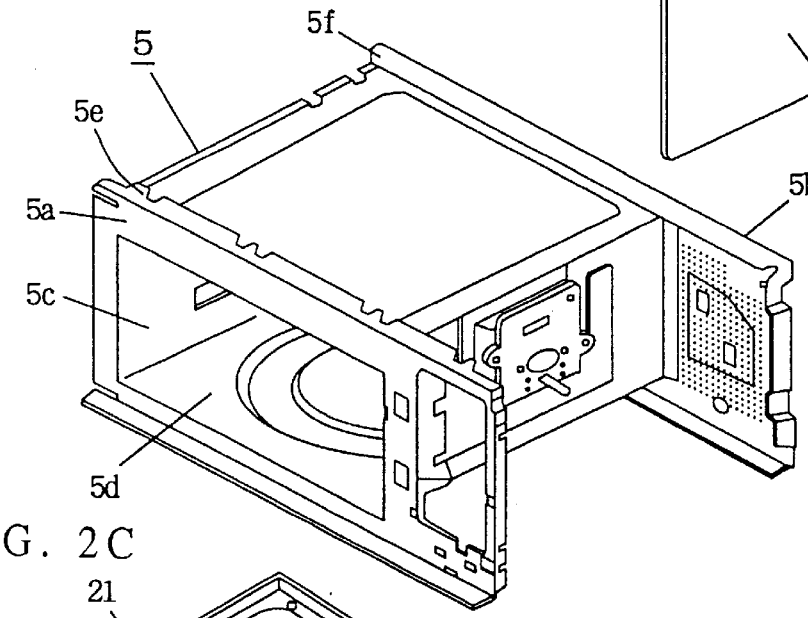
Figure 2C:
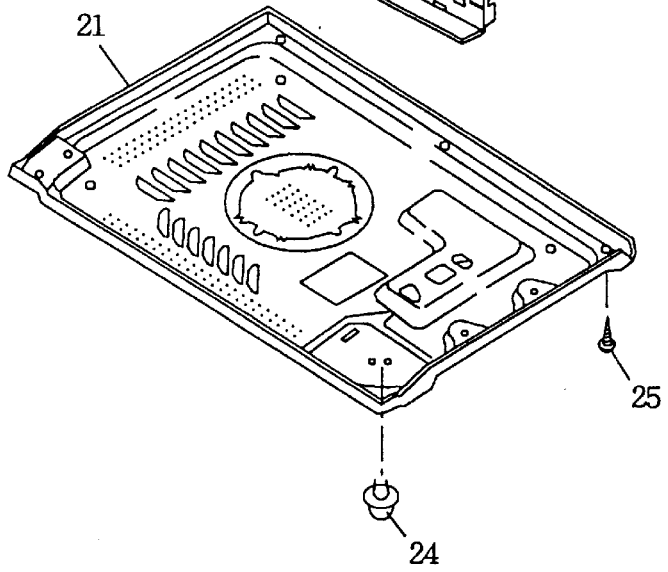

The entire configuration of a microwave oven as an example of the high frequency heating device according to the present invention will now be described. FIGS. 2A, 2B and 2C are exploded perspective views of a microwave oven as one example of the high frequency heating device according to the present invention. FIGS. 2A, 2B and 2C only show the framework of the device and do not show the door provided at the front side or parts, such as an internal circuit.

Referring to FIGS. 2A, 2B and 2C, the microwave oven is formed of an exterior 4, a body 5 which includes a heating chamber 5*d,* and a lower plate 21.

Exterior 4 has one plane 4*a* extending in the horizontal direction and two planes 4*b* and 4*c* extending perpendicular to plane 4*a,* and each plane has a flange (not shown) perpendicular to each plane at an end 46, 47, 48. Exterior 4 is mounted on body 5 by screwing a plurality of screws, such as a screw 6*a,* 6*b,* into the flanges of planes 4*a*–4*c*. It should be noted that a screw 7 is one example of the switching member and used for the exterior switch input described later, rather than for mounting of the exterior. Lower plate 21 is mounted on body 5 by a plurality of screws, such as a screw 24, 25.

Body 5 is provided with a front plate 5*a* and a rear plate 5*b,* and respective upper ends of front plate 5*a* and rear plate 5*b* are provided with flanges 5*e* and 5*f* which bend inwards, respectively. Body 5 surrounds a heating chamber 5*d* for housing foods or the like to be heated, and an opening Sc is provided at the front side of heating chamber 5*d*. Opening 5*c* is covered with a door (not shown) which can be opened and closed freely. Provided at the right side of heating chamber 5*d* is a space sandwiched between front plate 5*a* and rear plate 5*b*, in which space parts (not shown) such as the circuit shown in FIG. 1, are arranged.

Figure 3:
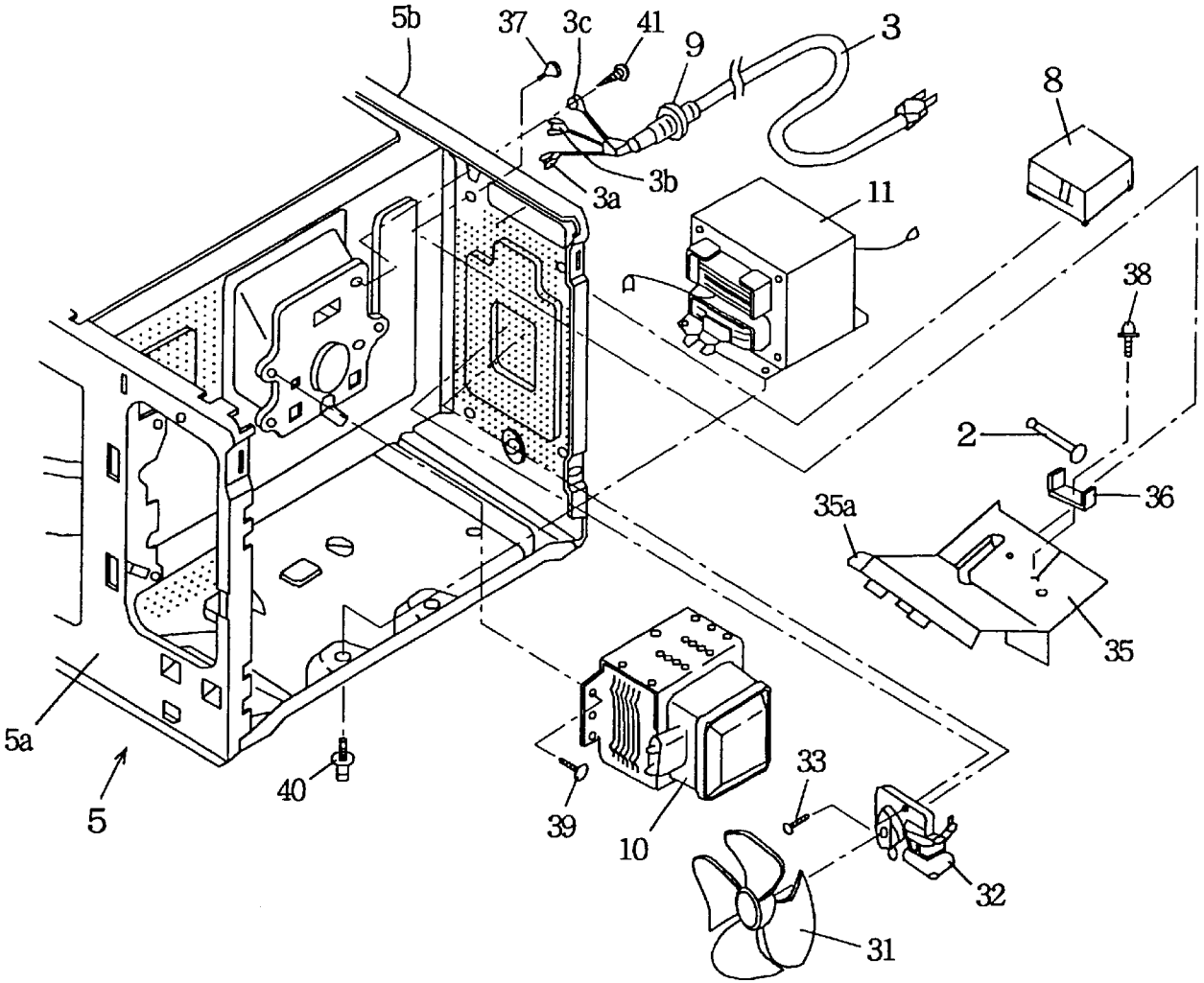
FIG. 3 is a partial, exploded perspective view of the body.
Figure 4A:
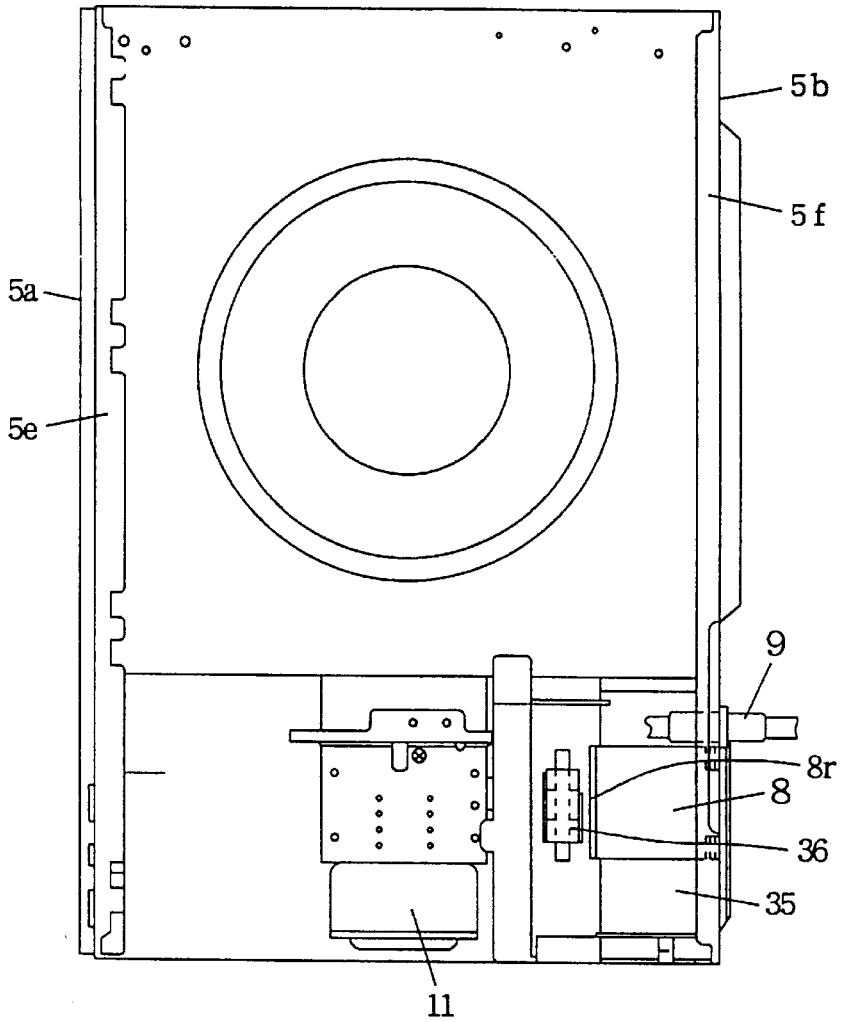
FIGS. 4A and 4B are plan and right-side views of the body, respectively.
Figure 4B:
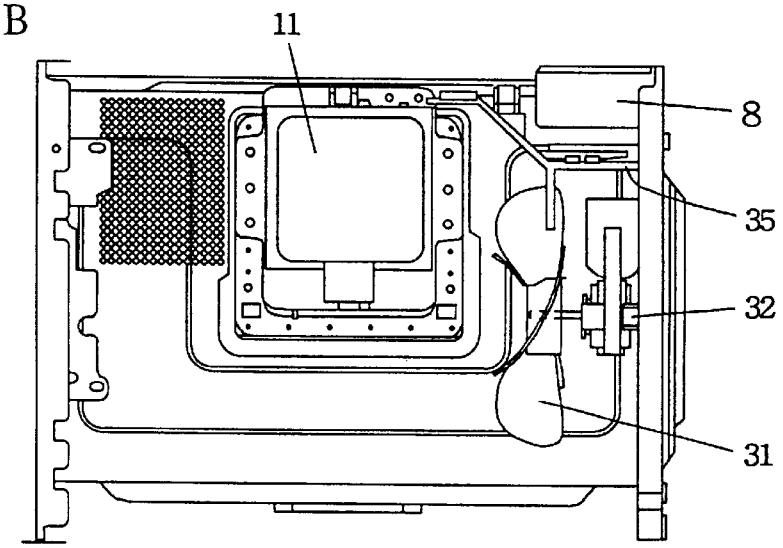

An arrangement of the parts will now be described. FIG. 3 is a partially exploded, perspective view of body 5 for illustrating the arrangement of the parts in the space sandwiched between front plate 5*a* and rear plate 5*b* on the right side of heating chamber 5*d* shown in FIGS. 2A, 2B and 2C. FIGS. 4A and 4B show the arrangement of the parts in the space, and FIG. 4A is a plan view of body 5 and FIG. 4B is a right side view of body 5.

Referring to FIGS. 3, 4A and 4B, magnetron 10 and high voltage transformer 11 are mounted on body 5 by screws 39 and 40.

A cooling fan 31 as one example of cooling means cools magnetron 10, and fan motor 32 drives cooling fan 31. Fan motor 32 is mounted on rear plate 5*b* by screw 33, and cooling fan 31 is mounted on fan motor 32 by screwing in a screw portion (not shown) provided at the rear side of cooling fan 31.

Fan guide 35 is provided above cooling fan 31 by fixing a portion (not shown) extending vertically downward by screw 37 and also fixing a portion 35*a* extending vertically upward by a screw (not shown). Fan guide 35 is one example of a diaphragm which divides the space in body 5 that is positioned on the right side of heating chamber 5*d* and sandwiched between front plate 5*b* and rear plate 5*b* into a plurality of spaces,, and is provided for more efficiently sending the air caused by cooling fan 31 to magnetron 10.

Provided above fan guide 35 is a switch case 8 as one example of a box member 8 for housing all of current receiving switch 1*a*, ground switch 1*b* and a connection terminal, which will be described later, of these switches. Switch case 8 is mounted above fan guide 35 around an upper end of rear plate 5*b* by fitting a convex portion (not shown) positioned at a side surface of switch case 8 into a fitting hole (not shown) positioned around the upper end of rear plate 5*b*. Switch case 8 is provided with a bendable portion of the upper lid and the structure of switch case 8 will be detailed later.

A fuse case 36 for housing fuse 2 is fixed on fan guide 35 by screw 38.

A power feed line 3 is fixed by fitting a bush as a portion of the power feed line positioned near an end thereof into a hole positioned near an upper end of rear plate 5*b*. Power feed line 3 has three terminals 3*a*–3*c*. Terminal 3*a* is connected to a line into which commercial alternating current of power feed line 3 flows, and terminals 3*b* and 3*c* are connected to the ground side. Terminals 3*a* and 3*b* are connected to current receiving switch 1*a* and ground switch 1*b* in switch case 8, respectively. Terminal 3c is connected to body 5 by screw 41 and ultimately connected to the ground portions of magnetron 10 and the peripheral parts thereof (FIG. 1). FIG. 4 does not show electrical interconnections between parts.

Figure 5:
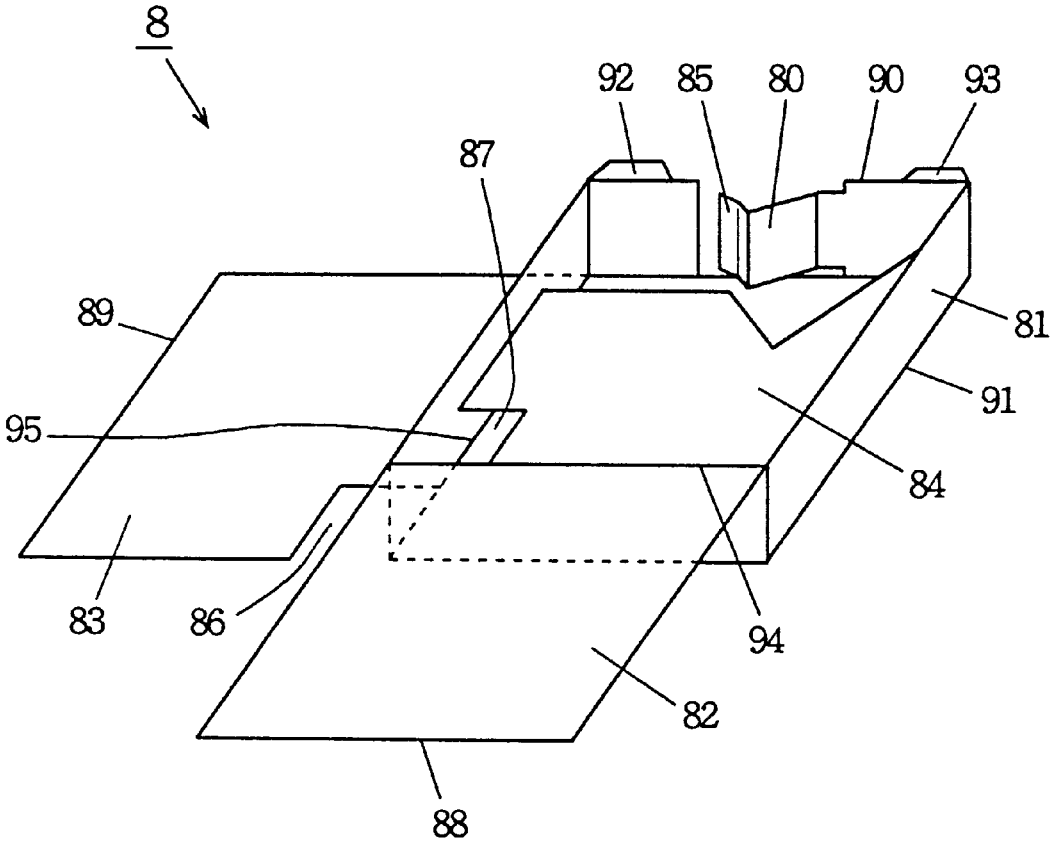
FIG. 5 is a perspective view of a switch case.

A structure of switch case 8 will now be described. FIG. 5 is a perspective view of an empty switch case 8 with its lids open.

Referring to FIG. 5, switch case 8 is provided with a body 81, an upper lid 82, a lower lid 83 and a center plate 84 which approximately halves body 81 into upper and lower portions. Body 81 is a column and has a rectangular cross section, and a portion of one surface of body 81 is provided with a spring operator portion 80. One end of operator portion 80 is supported by body 81, the other end of operator portion 80 does not contact body 81, and the width of operator portion 80 is narrower than the other portion of the body. The other end of operator portion 80 is provided with a wing 85.

Upper lid 82 and lower lid 83 are bendably connected to body 81 by bendable portions 94 and 95, respectively. FIG. 5 shows upper and lower lids 82 and 83 in their respective opened positions. In order to put the both lids into their respective closed positions, ends 88 and 89 of the lids that are positioned opposite to bendable portions 94 and 95 are brought into contact with ends 90 and 91 of body 81, respectively. Ends 81 and 89 of the lids and ends and 91 are appropriately provided with a protruded portion which is fitted in the contact and a fitting hole into which the protruded portion is fitted, although they are not shown in FIG. 5.

Switch case 8 is mounted to body 5, as shown in FIGS. 4A–4B, such that bendable portion 94 of upper lid 82 is positioned opposite rear plate 5*b*, and thus end 81 of the upper lid 82 comes in contact with rear plate 5*b*. Thus, when switch case 8 is mounted to body 5 with upper lid 82 in its closed position, end 81 of the upper lid is pressed by flange 5*f* and thus upper lid 82 cannot open for itself. This means that flange 5*f* constitutes a first flange.

Switch case 8 can house current receiving switch 1*a* and ground switch 1*b* (FIG. 1), as is described above, and two switches are arranged, one above the center plate 84 and the other below center plate 84.

Center plate 84 and lower lid 83 are provided with cuts 87 and 86 at a corner. Cut 87 in center plate 84 is formed at a position corresponding to cut 86 in lower lid 83 when lower lid 83 is in its closed position, and, for example, when switch case 8 is seen from above with upper and lower lids 82 and 83 in their respective opened positions, one can seek below switch case 8 through cut 87. By forming cuts 87 and 86 in such a positional relation, wiring which extends from the connection terminal of the switch housed in the upper portion of switch case 8 can be extended downward through cut 87, and thus the wiring can be externally extended through one portion, cut 86, together with wiring which extends from the connection terminal of the switch housed in the lower portion of switch case 8 in closing upper and lower lids 82 and 83.

Right and left upper portions of body 81 are provided with convex portions 92 and 93 which are fitted into fitting holes formed at an upper end of rear plate 5*b* when switch case 8 is mounted to rear plate 5*b*.

A manner in which switch case 8 houses current receiving switch 1*a* and ground switch 1*b* will now be described with reference to FIGS. 6 and 7.

Figure 6B:
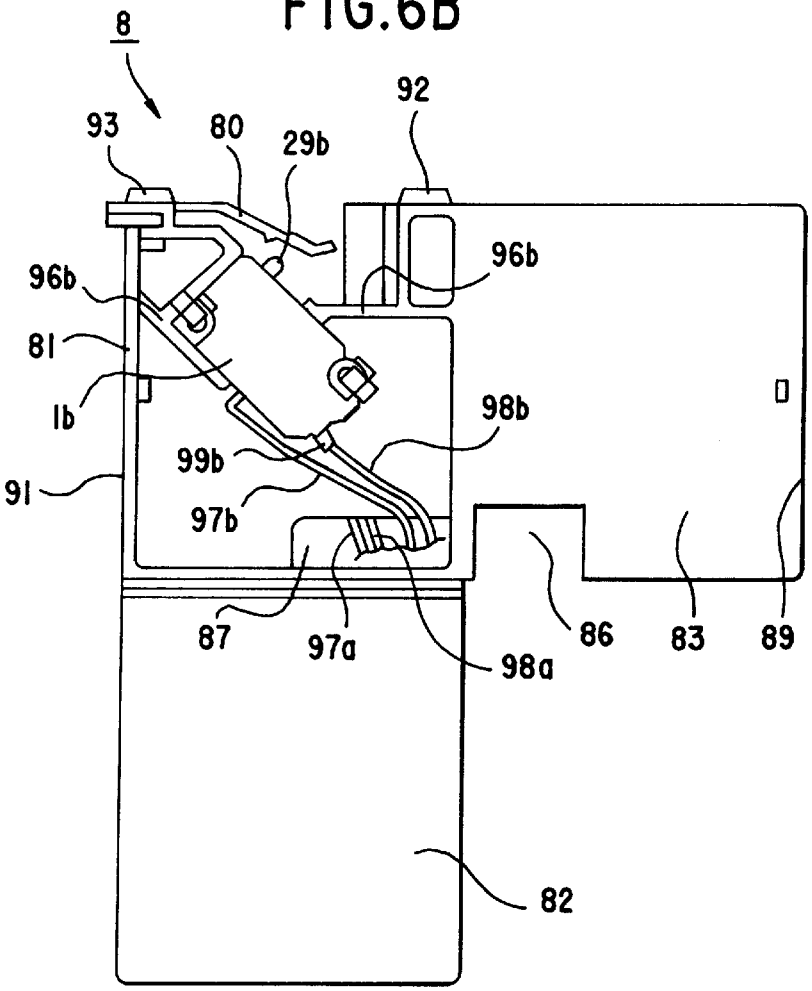
FIGS. 6A and 6B are top and bottom views of the switch case, respectively.
Figure 6A:
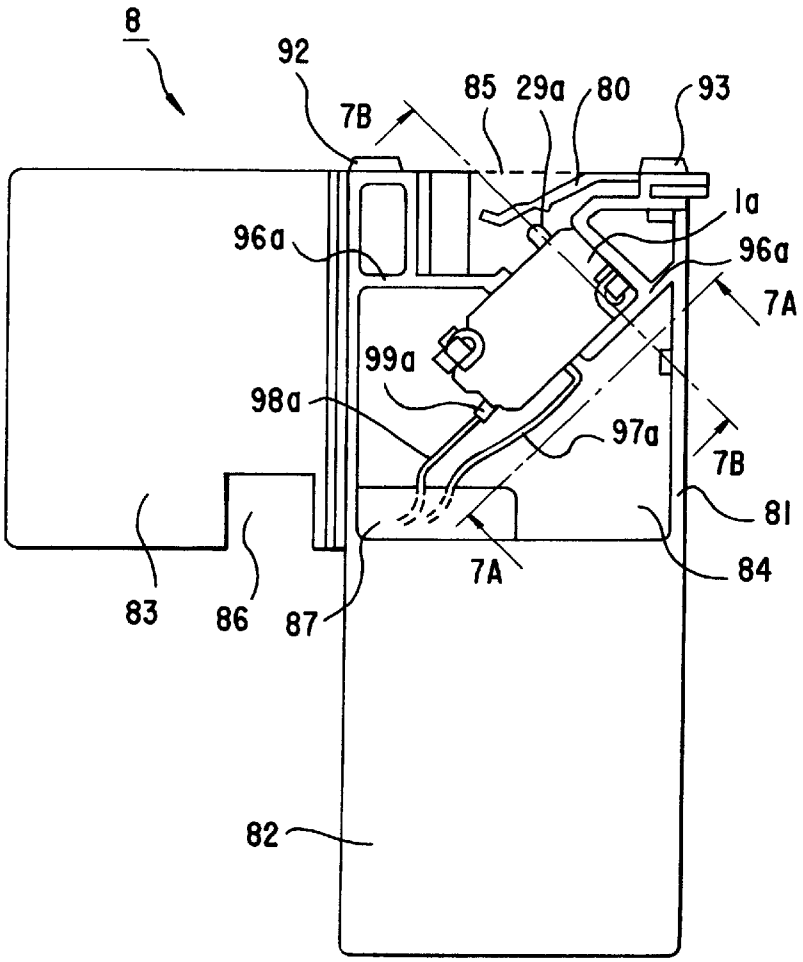
Figure 7A:
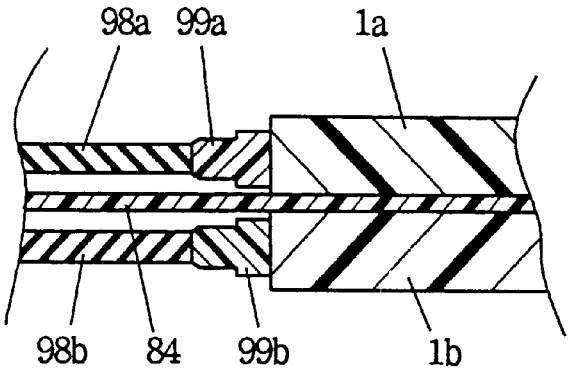
FIGS. 7A and 7B are partial, cross sectional views taken along lines 7A—7A and 7B—7B in FIG. 6A, respectively, when seen in the direction of the arrows.
Figure 7B:
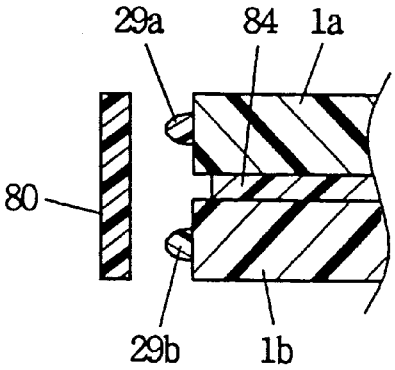

FIGS. 6A and 6B are top and bottom views, respectively, of switch case 8 which houses current receiving switch 1*a* and ground switch 1*b*, with upper and lower lids 82 and 83 in their respective opened position. FIGS. 7A and 7B are views for illustrating a positional relation between center plate 84, operator portion 80, current receiving switch 1*a* and ground switch 1*b* shown in FIGS. 6A and 6B.

Referring to FIG. 6A, current receiving switch 1*a* is arranged within switch case 8 above center plate 84. Current receiving switch 1*a* is fixed by a fixing member 96*a* provided within switch case 8. Current receiving switch 1*a* includes an input button 29*a* which closes the power supply circuit (FIG. 1) of current receiving switch 1*a* when input button 29*a* is pressed, and input button 29*a* is arranged opposite to operator portion 80. When wing 85 is pressed by the switching member (screw 7) described later, operator portion 80 is pressed against input button 29*a* which then causes current receiving switch 1*a* to close the power supply circuit shown in FIG. 1. It should be noted that wing 85 of operator portion 80 is formed inside the plane indicated by the broken line, that is, the plane at which operator portion 80 is formed. Switch input member 7 presses wing 85 when switching member 7 is inserted into body 5.

Wiring 97*a* and 98*a* are used for connecting current receiving switch 1*a* to power feed line 3 and fuse 2 (FIG. 1) and covered with an insulating material. A connection terminal 99*a* is inserted between current receiving switch 1*a* and wiring 98*a*. Wiring 97*a* and 98*a* are guided under center plate 84 through cut 87 formed in center plate 84.

Referring to FIG. 6B, ground switch 1*b* is arranged within switch case 8 under center plate 84 and fixed by a fixing member 96*b*.

Ground switch 1*b* is connected to wiring 97*b*, 98*b* covered with an insulating material, and a connection terminal 99*b* is inserted between ground switch 1*b* and wiring 98*b*. Wiring 97*a*, 98*a* connected to current receiving switch 1*a* as well as wiring 97*b*, 98*b* guided from the back side through cut 87 are guided to the outside of switch case 8 through cut 86 formed in lower lid 83.

Ground switch 1*b* and current receiving switch 1*a* have a same shape and are symmetric in configuration and position with respect to center plate 84.

FIG. 7A is a partial cross sectional view taken along line 7A—7A shown in FIG. 6A, when seen from the direction of the arrows. Wiring 97*a* is not shown in FIG. 7A. As described above, current receiving switch 1*a* and ground switch 1*b* are symmetrically arranged with center plate 84 interposed therebetween, and thus connection terminals 99*a* and 99*b* are symmetrically positioned with center plate 84 interposed threbetween in FIG. 7A.

As with input button 29*a* of current receiving switch 1*a*, ground switch 1*b* includes an input button 29*b* which is arranged opposite to operator portion 80 and causes ground switch 1*b* to close the power supply circuit shown in FIG. 1 when input button 29*b* is pressed.

Thus, input buttons 29*a* and 29*b* configures a convex operating portion. A positional relation between operator portion 80 and input buttons 29*a* and 29*b* will now be described.

FIG. 7B is a partial cross sectional view taken along line 7B—7B shown in FIG. 6A, when seen from the direction of the arrows. Referring to FIG. 7B, current receiving switch 1*a* and ground switch 1*b* are positioned above and below center plate 84, respectively. Input buttons 29*a* and 29*b* protrude from an end of current receiving switch 1*a* and ground switch 1*b* toward operator portion 80, respectively, as described above. Thus, operator portion 80 can press input buttons 29*a* and 29*b* simultaneously.

The displacement of wing 85 when it is pressed by switching member 7 will now be described in detail.

Figure 8A:
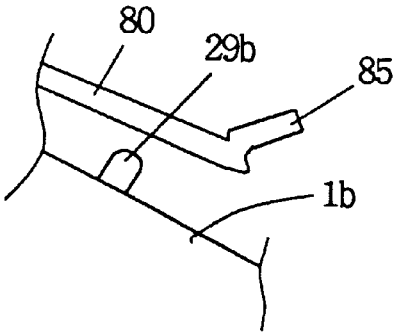
FIGS. 8A and 8B are views for illustrating the displacement of a wing when it is pressed by the switching member.
Figure 8B:
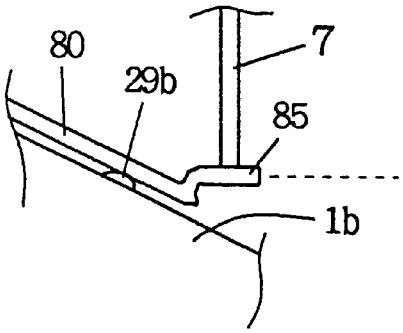

FIGS. 8A and 8B illustrate the displacement of wing 85 when it is pressed by switching member 7. FIG. 8A shows the state before wing 85 is pressed and FIG. 8B shows the state when wing 85 is pressed.

As shown in FIG. 8A, wing 85 extends from an end of operator portion 80 upwards at an angle to the right before wing 85 is pressed. As shown in FIG. 8B, wing 85 is displaced perpendicular to switching member 7 when wing 85 is pressed by switching member 7.

The detail of the structure of body 5 will now be described when switch case 8 which houses ground switch 1*b* and current receiving switch 1*a* is fixed to body 5.

Figure 9A:
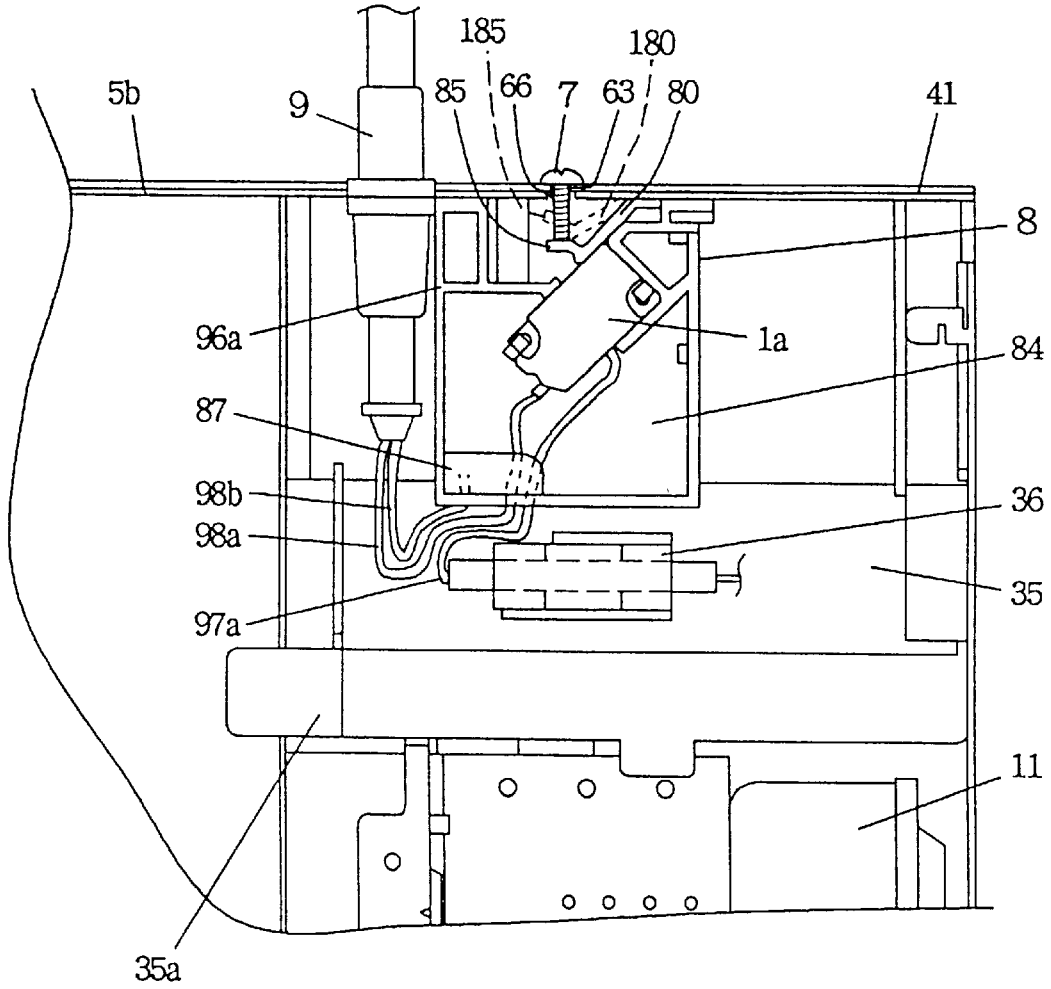
FIG. 9A is a partial plan view of the body.
Figure 9B:
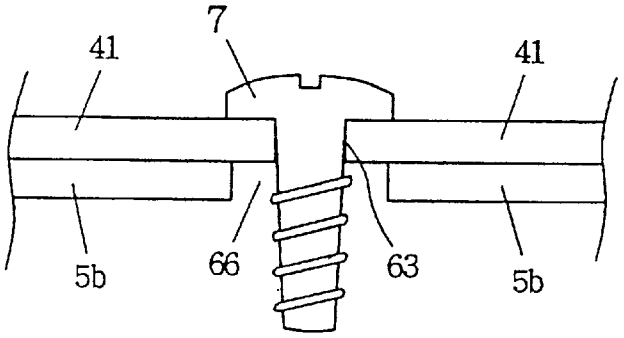
FIG. 9B is a view for illustrating a positional relation between the switching member, a hole and a through hole.
Figure 10A:
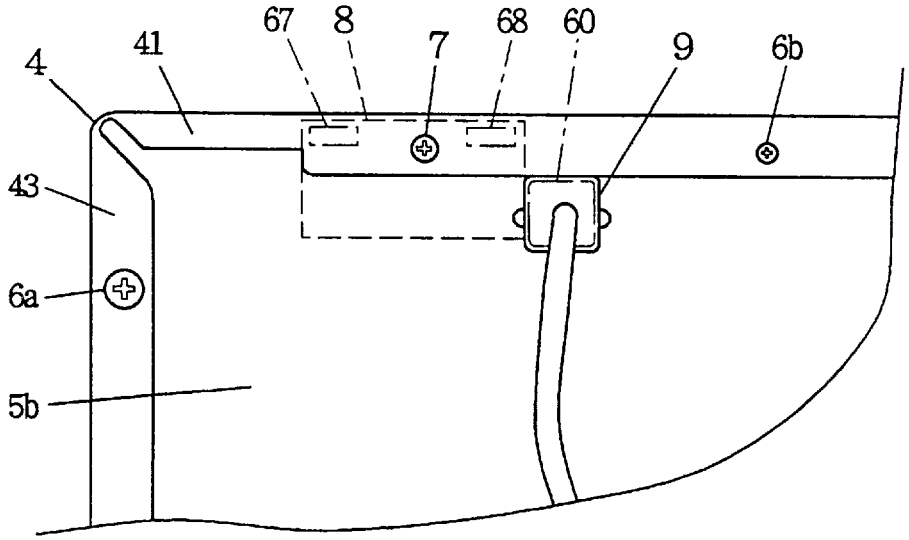
FIG. 10B is a rear view of the exterior.
FIG. 10C is a rear view of the body when the exterior is not mounted thereto.
Figure 10B:
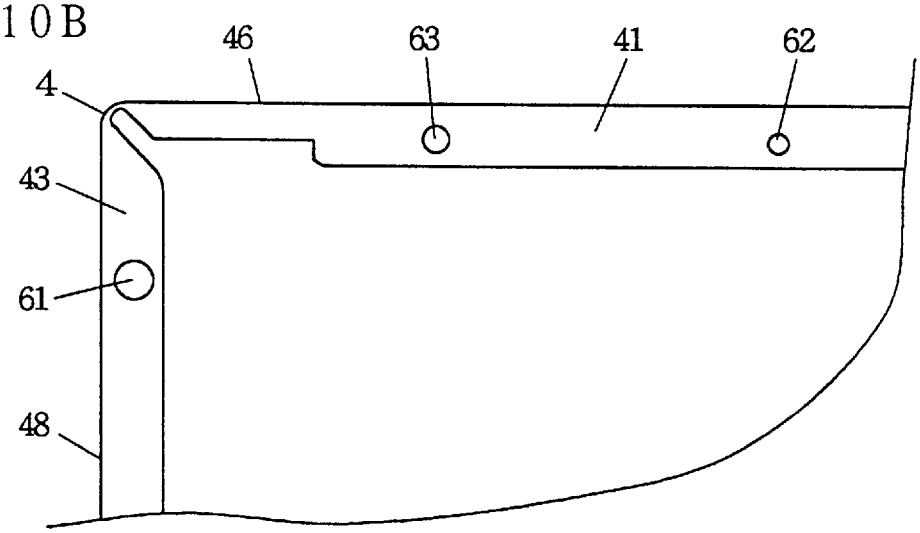
Figure 10C:
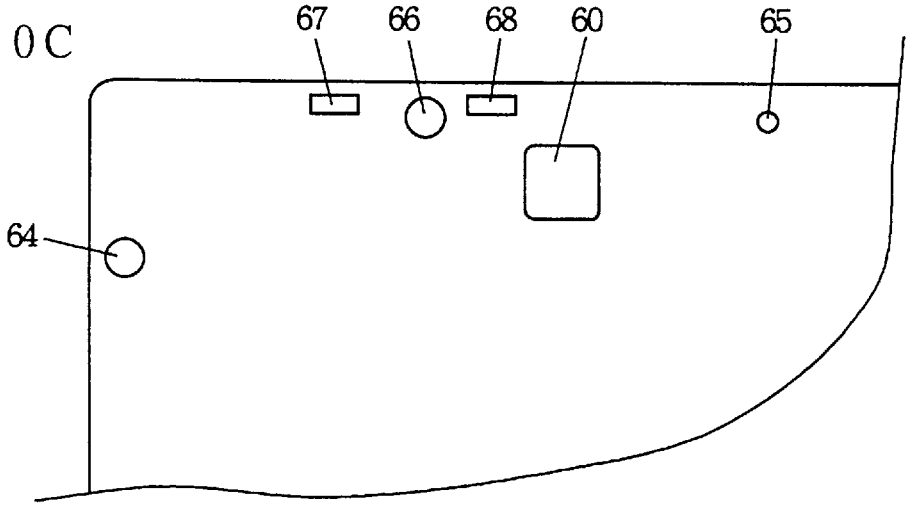

FIG. 9A is a partial plan view of body 5 and is an enlarged view of that portion in the plan view of FIG. 4A which includes switch case 8 and bush 9. Upper lid 82 of switch case 8 and flange Sf of body 5 are not shown in FIG. 9A. An exterior flange 41 is positioned at the upper end of the rear side of body 5 when exterior 4 is mounted on body 5 (FIGS. 2A, 2B and 2C). Plane 43 is that of exterior 4. FIG. 9B illustrates a positional relation between switching member 7, a hole 63 and a through hole 66. FIGS. 10A–10C illustrate a structure of body 5 and exterior 4 at the rear side. FIG. 10A is a rear view of body 5 with exterior 4 mounted thereon, FIG. 10B is a rear view of exterior 4, and FIG. 10C is a rear view of body 5 onto which exterior 4 is not mounted.

Referring to FIGS. 9A and 9B, and 10A–10C, current receiving switch 1*a* housed by switch case 8 is connected to one end of fuse 2 and power feed line 3 via wiring 97*a*, 98*a*. Ground switch 1*b* positioned at the back side of center plate 84 is connected to power feed line 3 via wiring 98*b*. Wiring which extends from the other end of fuse 2 and wiring 97*b* are not shown in the figures.

Referring to FIG. 10B, rear ends 46 and 48 of exterior 4 are provided with exterior flanges 41 and 43 perpendicular to planes 4*a* and 4*c* (FIGS. 2A, 2B and 2C). Switch case 8 is fixed to body 5 by fitting convex portions 92 and 93 (FIG. 5) into fitting holes 67 and 68 (FIG. 10C) formed in the rear surface of body 5. As shown in FIG. 10A, fitting holes 67 and 68 are formed at such positions that they are covered with flange 41 of exterior 4 when exterior 4 is mounted on body 5. That is, exterior flange 41 constitutes a second flange.

Bush 9 of power feed line 3 is fixed when bush 9 is plugged into a bush hole 60 (FIG. 10C) formed in the rear surface of body 5. As is described above, ground switch 1*b* and current receiving switch 1*a* within switch case 8 are connected to power feed line 3, and the length of wiring 98*a*, 98*b* for the connection does not much include an extra length. Thus, when bush 9 of power feed line 3 is fixed to body 5, switch case 8 will also be fixed to body 5.

In FIG. 9, screw (switching member) 7 presses wing 85 and thus operator portion 80 presses input button 29*a* of current receiving switch 1*a*. It should be noted that broken lines 180 and 185 indicate the operator portion and wing, respectively, before wing 85 is pressed. Screw 7 is screwed into a screw hole 63 formed in flange 41 of exterior 4 and is thus fixed to exterior 4, and is further fixed to body 5 when exterior 4 is fixed to body 5. Through hole 66 formed that portion of rear plate 5*b* of body 5 through which screw 7 passes is, however, too large for screw 7. Thus, screw 7 can be fixed to exterior 4 but cannot be fixed to body 5 onto which exterior 4 is not mounted.

Figure 11:
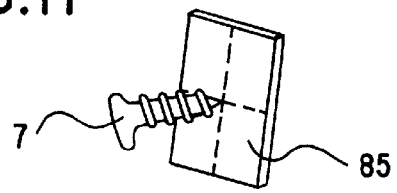
FIG. 11 illustrates how the switching member presses the wing.

A positional relation between screw 7 and wing 85 when screw 7 as one example of the switching member presses wing 85 will now be described. FIG. 11 is a lateral view for illustrating the state when screw 7 presses wing 85. Referring to FIG. 11, screw 7 is arranged such that the tip thereof is positioned at the center of wing 85 when screw 7 presses wing 85.

In the embodiment described above, body 81 and lower lid 83 or body 81 and center plate 84 forms a housing portion for housing exterior switch 1 (current receiving switch 1*a* and/or ground switch 1*b*) and the connection terminal (connection terminal 99*a* and/or connection terminal 99*b*).

In the above embodiment also, screw 7 forms a switching member which operates so that current receiving switch 1*a* and ground switch 1*b* as one example of the exterior switch close the power supply circuit shown in FIG. 1 when exterior 4 is mounted on body 5 and current receiving switch 1*a* and ground switch 1*b* open the power supply circuit shown in FIG. 1 when exterior 4 is removed from body 5. Although a switching member formed of screw 7 is fixable only to exterior 4 and cannot be fixed to body 5 onto which exterior 4 is not mounted, the switching member may be provided integral to exterior 4.

In the embodiment described above, current receiving switch 1*a* and ground switch 1*b* within switch case 8 are arranged symmetrically with respect to center plate 84 so that operator portion 80 simultaneously presses input buttons 29*a* and 29*b* when operator portion 80 is pressed by switching member 7. Arrangement of current receiving switch 1*a* and ground switch 1*b* is not limited to this arrangement. For example, current receiving switch 1*a* and ground switch 1*b* may be arranged so that operator portion 80 first presses input button 29*b* and then presses input button 29*a* when operator portion 80 is pressed by switching member 7.

While the box member according to the present invention is formed of switch case 8 which houses current receiving switch 1*a,* ground switch 1*b,* a portion of wiring 97*a,* 97*b,* 98*a,* 98*b* and connection terminals 99*a* and 99*b* in the above embodiment, the box member according to the present invention can also be provided with a member for housing parts for the power supply circuit.

Figure 12A:
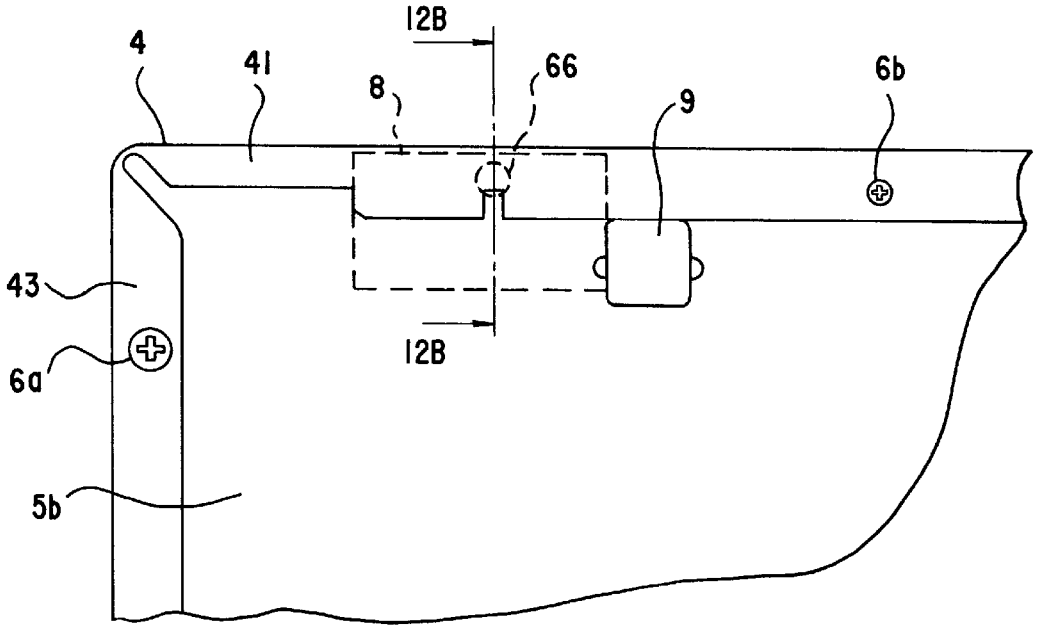
FIG. 12A is a partial rear view of the body when the exterior is mounted thereto in another embodiment of the present invention.
Figure 12B:
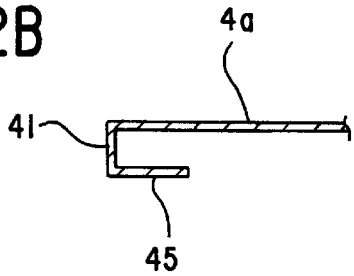
FIG. 12B is a cross sectional view of the exterior taken along line 12B—12B in FIG. 12A.

FIGS. 12A and 12B show another embodiment of the present invention in which a switching member is provided integral to exterior 4. FIG. 12A is a partial rear view of body 5 which exterior 4 mounted thereon and FIG. 12B is a cross sectional view of exterior 4 taken along line 13B—13B shown in FIG. 12A.

Referring to FIGS. 12A and 12B, a portion of exterior flange 41 that corresponds through hole 66 formed in body 5 is cut and erected perpendicular to exterior flange 41 in this embodiment to form an erect portion 45. Erect portion 45 passes through through hole 66 and presses wing 85 (FIG. 9A) of switch case 8.

Figure 13A:
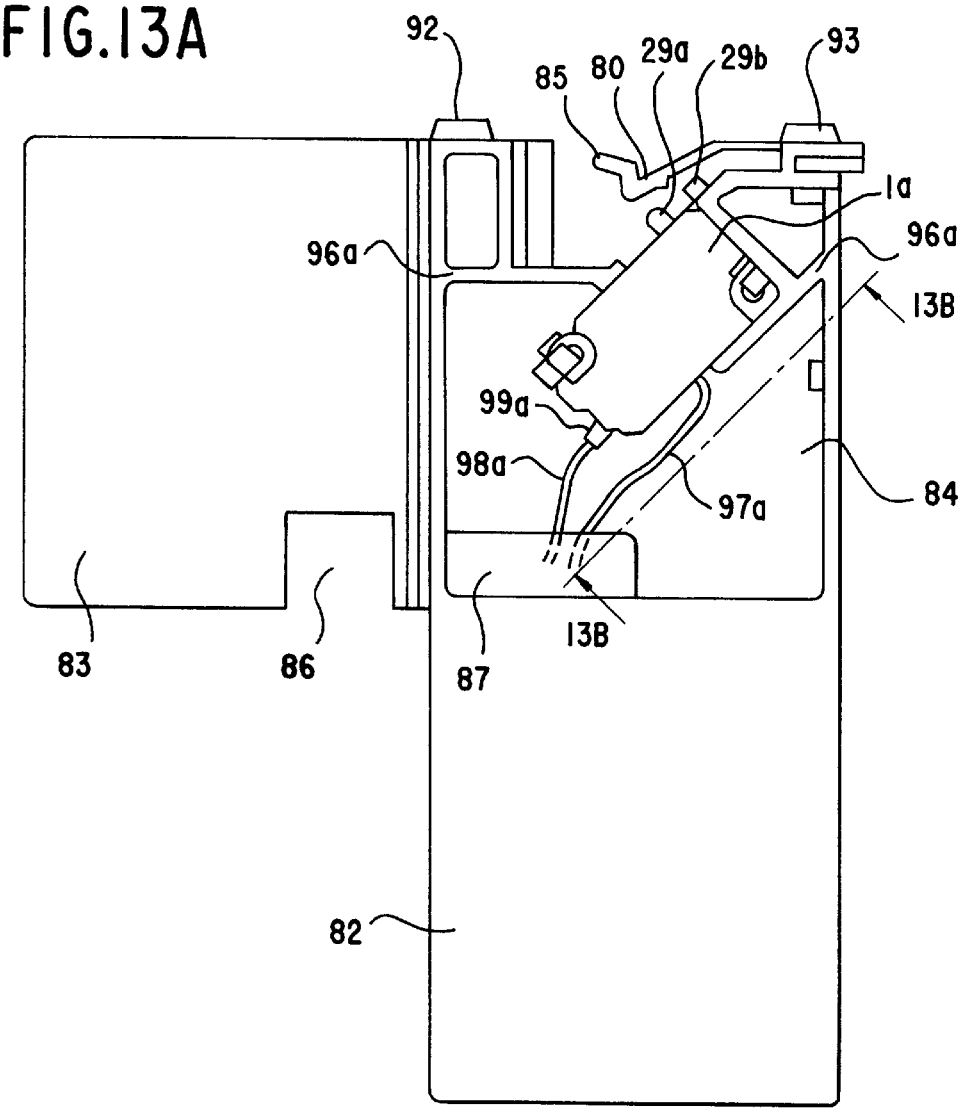
FIG. 13A is a plan view of the switch case.
Figure 13B:
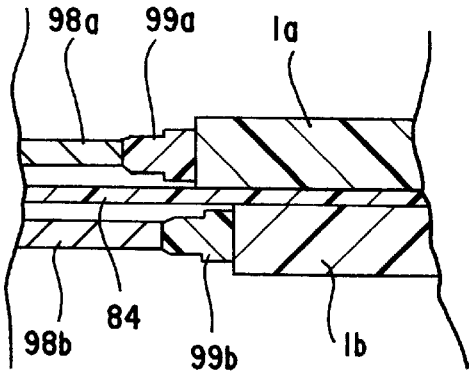
FIG. 13B is a partial cross sectional view taken along line 13B—13B in FIG. 13A when seen in the direction of the arrows.

FIGS. 13A and 13B show still another embodiment in which current receiving switch 1*a* and ground switch 1*b* are arranged within switch case 8 such that the distance from input button 29*a* to operator portion 80 is longer than that from input button 29*b* to operator portion 80 and thus operator portion 80 first presses input button 29*b* and then presses input button 29*a* when operator portion 80 is pressed by switching member 7. FIG. 13A is a top view of switch case 8 and FIG. 13B is a partial cross sectional view taken along line 13B—13B of FIG. 13A when seen in the direction of the arrows.

Referring to FIGS. 13A and 13B, ground switch 1*b* is fixed at a position displaced in the longitudinal direction of current receiving switch 1*a* from the position which is symmetrical to that of current receiving switch 1*a* with respect to center plate 84. Accordingly, connection terminal 99*b* is arranged at a position displaced in the longitudinal direction of current receiving switch 1*a* from the position which is symmetrical to that of connection terminal 99*a* with respect to center plate 84, and input button 29*b* is seen through the cut in center plate 84 when switch case 8 on the ground side is seen from the above.

Referring to FIGS. 13A and 13B, current receiving switch 1*a* and ground switch 1*b* are arranged such that the distance from input button 29*a* to operator portion 80 is longer than that from input button 29*b* to operator portion 80 and accordingly, operator portion 80 presses input button 29*b* earlier than input button 29*a* when operator portion 80 is pressed by switching member 7. Thus, when operator portion 80 is pressed by switching member 7, ground switch 1*b* can be set into the state in which the circuit is closed earlier than current receiving switch 1*a*.

Figure 14A:
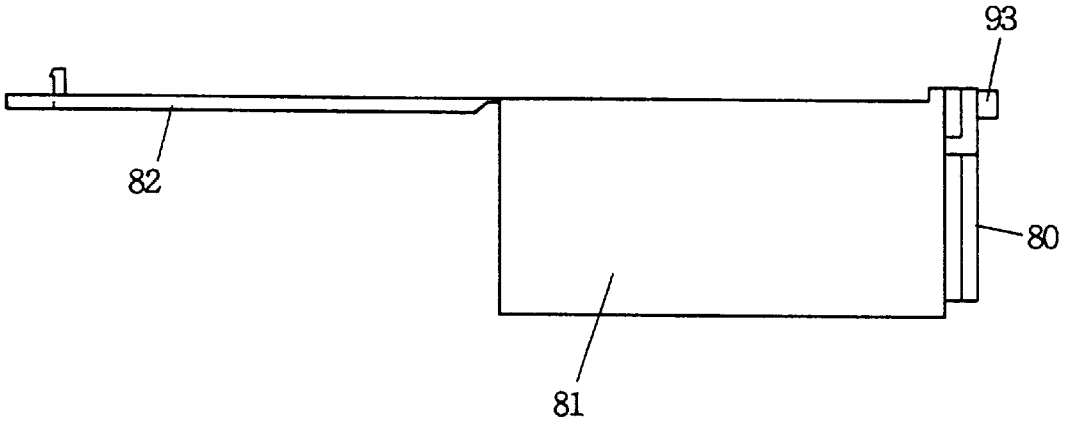
FIG. 14A is a left side view of a switch case according to an embodiment of the present invention.
Figure 14B:
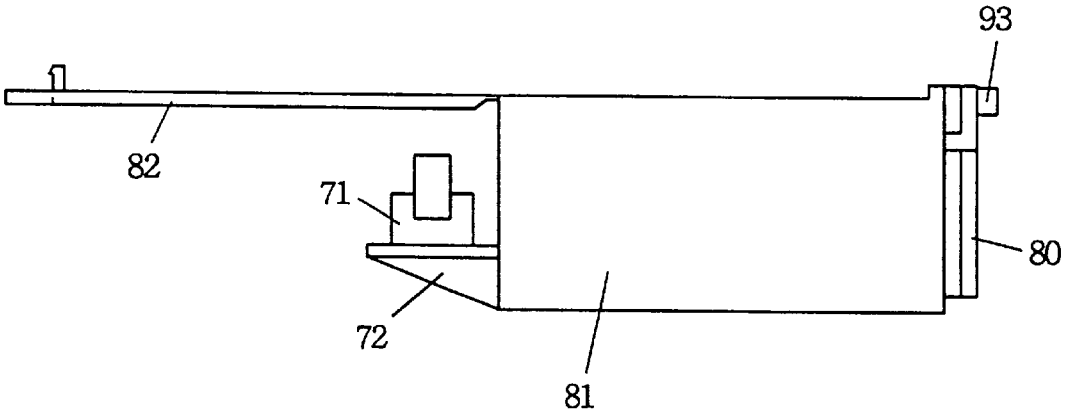
FIG. 14B is a left side view of a switch case according to another embodiment of the present invention.
Figure 15:
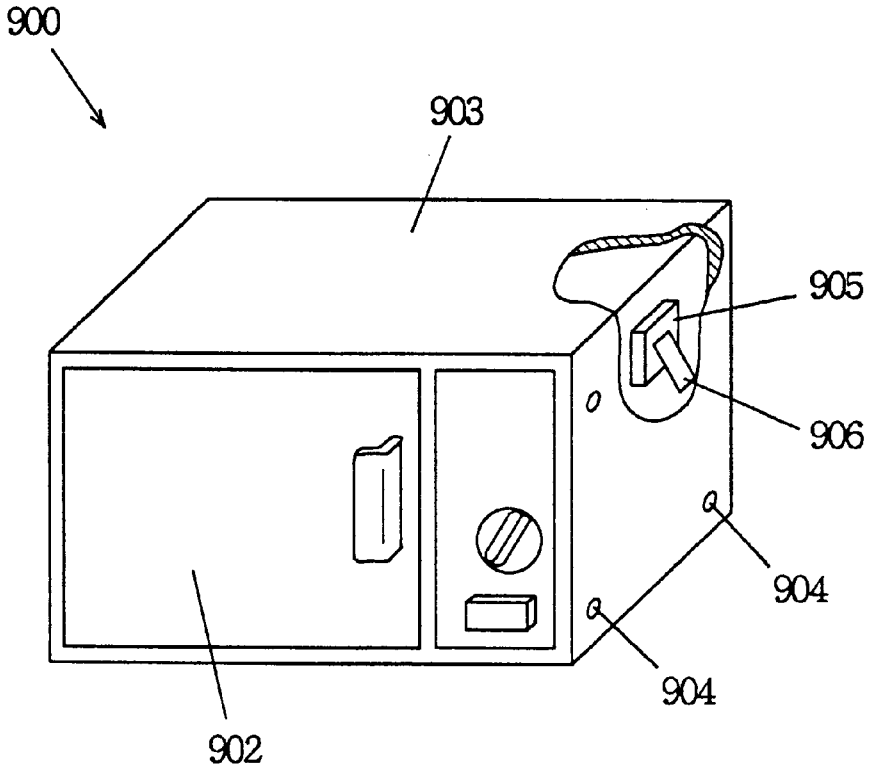
FIG. 15 PRIOR ART
FIG. 15 is a partially exploded, perspective view of one example of conventional microwave ovens.

FIGS. 14A and 14B are left side views of switch case 8 according to the present invention. FIG. 14A is a left side view of switch case 8 according to an embodiment of the present invention. FIG. 14B is a left side view of switch case 8 of another embodiment according to the present invention in which switch case 8 as one example of the box member according to the present invention is further provided with a member for housing a fuse as one example of a part for the power supply circuit.

As compared with switch case 8 in FIG. 14A, switch case 8 in FIG. 14B are provided with a case base 72 fixed outside the rear surface positioned opposite to the front surface having a convex portion 93 and operator portion 80, and a fuse case portion 71 fixed onto case base 72. Fuse case portion 71 forms the member for housing parts for the power supply circuit.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high frequency heating device comprising:

high frequency heating means;

a power supply circuit for supplying voltage to said high frequency heating means;

a heating chamber for housing a food to be heated by said high frequency heating means;

a body surrounding said heating chamber and having said high frequency heating means and said power supply circuit fixed thereto;

a removable exterior for covering an outer surface of said body;

an exterior switch arranged between said exterior and said heating chamber for opening and closing said power supply circuit; and a switching member provided at said exterior and separately from said exterior switch for operating said exterior switch to close said power supply circuit when said exterior is mounted on said body and to open said power supply circuit when said exterior is removed from said body.

2. The high frequency heating device according to claim 1, wherein said switching member is fixable only to said exterior and causes said exterior switch to close said power supply circuit through fixation of said switching member to said exterior when said exterior is mounted on said body.

3. The high frequency heating device according to claim 1, wherein said switching member is provided integral to said exterior.

4. The high frequency heating device according to claim 1, further comprising a box member fixed to said body, and a connection terminal for connecting said exterior switch to said power supply circuit, wherein said box member houses said exterior switch and said connection terminal.

5. The high frequency heating device according to claim 4, further comprising cooling means for cooling said high frequency heating means, and a diaphragm provided over said cooling means for dividing said body into a plurality of spaces, wherein said box member is arranged over said diaphragm.

6. The high frequency heating device according to claim 4, wherein:

said body has a side surface onto which said box member is mounted;

said side surface is provided with a first flange at an upper end;

said box member includes a housing portion for housing said exterior switch and said connection terminal, and a lid covering said housing portion and having one end bendably fixed to said housing portion; and said box member has an end of said lid opposite to said one end of said lid bendably fixed to said housing portion, said end being fixed such that said end is covered with said first flange.

7. The high frequency heating device according to claim 6, further comprising a power feed line for connecting said power supply circuit to an external power supply, wherein:

said exterior switch is connected to said power feed line;

a portion of said power feed line is fixed to said body; and said box member is fixed to said body when said portion of said power feed line is fixed to said body.

8. The high frequency heating device according to claim 4, further comprising wiring for connecting said exterior switch to said power supply circuit, wherein said box member is provided with a hole so that said wiring is pulled out from one point.

9. The high frequency heating device according to claim 4, wherein said box member houses a plurality of said exterior switches and has an operator portion causing said plurality of exterior switches to close said power supply circuit when said switching member presses said operator portion.

10. The high frequency heating device according to claim 9, wherein said switching member is fixed to said exterior such that said switching member presses a center of said operator portion when said exterior is mounted.

11. The high frequency heating device according to claim 9, further comprising a power feed line for connecting said power supply circuit to an external power supply, wherein:

said exterior switch has a convex operating portion for closing said power supply circuit when said convex operating portion is pressed;

said power feed line includes a first, current receiving line and a second, grounded line;

said box member houses a first exterior switch connected to said first line and a second exterior switch connected to said second line; and said first and second exterior switches are arranged in said box member such that said operator portion first presses said convex operating portion of said second exterior switch and then presses said convex operating portion of said first exterior switch when said operator portion is pressed by said switching member.

12. The high frequency heating device according to claim 9, wherein:

said operator portion has a wing at an end;

said switching member is arranged to press said wing when said exterior is mounted; and said wing is formed closer to a center of said box member than a plane at which said operator portion is formed.

13. The high frequency heating device according to claim 12, wherein said wing is displaced perpendicular to said switching member when said switching member presses said wing.

14. The high frequency heating device according to claim 4, wherein:

said body is provided with a fitting hole for fixing said box member; and said exterior is provided with a second flange for covering said fitting hole when said exterior is mounted.

15. The high frequency heating device according to claim 4, wherein said box member is further provided with a member for housing a part for said power supply circuit.

* * * * *